United States Patent [19]

Sudweeks et al.

[11] 4,141,767

[45] Feb. 27, 1979

[54] EMULSION BLASTING AGENT

[75] Inventors: Walter B. Sudweeks, Orem; Harvey A. Jessop, Lehi, both of Utah

[73] Assignee: IRECO Chemicals, Salt Lake City, Utah

[21] Appl. No.: 883,077

[22] Filed: Mar. 3, 1978

[51] Int. Cl.[2] ..... C06B 45/00

[52] U.S. Cl. ..... 149/2; 149/21; 149/46; 149/61; 149/83

[58] Field of Search ..... 149/46, 2, 83, 21, 61

[56] References Cited

U.S. PATENT DOCUMENTS 3,617,406 11/1971 Young ..... 149/46 X

*Primary Examiner*—Stephen J. Lechert, Jr.

*Attorney, Agent, or Firm*—Robert A. Bingham

[57] ABSTRACT

The invention relates to emulsified aqueous explosive blasting compositions having a discontinuous aqueous phase, a continuous oil or water-immiscible liquid organic phase, and a fatty acid amine or ammonium salt emulsifier having a chain length ranging from 14 to 22 carbon atoms.

15 Claims, No Drawings

EMULSION BLASTING AGENT

The present invention relates to improved explosive compositions and to a method of making the same. More particularly, the invention relates to emulsified aqueous explosive blasting compositions having a discontinuous aqueous phase and a continuous oil or water-immiscible liquid hydrocarbon phase. The compositions comprise (a) discrete droplets of an aqueous solution of inorganic oxidizer salt(s), (b) a water-immiscible liquid hydrocarbon fuel forming a continuous phase throughout which the droplets are dispersed, and (c) an emulsifier that forms an emulsion of the oxidizer salt solution droplets throughout the continuous hydrocarbon liquid phase. Preferably, the compositions contain a uniformly dispersed density reducing agent such as small glass or plastic spheres or microballoons, which increase composition sensitivity under relatively high pressures. The key ingredient of the present invention is the emulsifier, which is a fatty acid amine or ammonium salt having a chain length ranging from 14 to 22 carbon atoms. The method of the invention involves predissolving the emulsifier in the hydrocarbon fuel prior to adding both ingredient to the oxidizer salt solution for mixing. This enhances the ease of emulsification and thus reduces the amount of mixing or agitation required.

Aqueous blasting compositions or slurries generally have a continuous aqueous phase throughout which immiscible liquid hydrocarbon fuel droplets or solid ingredients may be dispersed. In contradistinction, the compositions of the present invention are termed "inverted phase" compositions due to the presence of the "water-in-oil" emulsion.

Inverted phase slurries or compositions are known in the art. See, for example, U.S. Pat. Nos. 3,447,978; Re 28,060; 3,765,964; 3,770,522; 3,212,945; 3,161,551; 3,376,176; 3,296,044; 3,164,503; and 3,232,019. Inverted phase slurries have certain distinct advantages over conventional slurry explosives, which themselves have become commercially popular due to their low cost, safety, fluidity (at least at time of formulation), and water resistability. Aqueous explosive compositions generally contain thickening agents for thickening the continuous aqueous phase so as to provide water resistance and to prevent segregation of solid, dispersed fuel and sensitizer ingredients. Thickening agents are also necessary to prevent coalescence or migration of dispersed immiscible liquid fuel droplets and sensitizing gas bubbles, if present. Not only are such thickening agents expensive, but also they tend to degrade with time, particularly under harsh environments, and thereby cause the composition to lose its stability and consequently its homogeneity, which is essential to a composition's sensitivity and thus detonability. A major advantage of innverted phase slurries is that they require no thickeners and cross-linkers. In fact, inverted phase slurries are very water-resistant without thickeners.

Other advantages of inverted phase slurries and particularly of the slurries of the present invention are manifest:

1. The inverted phase compositions of the present invention are relatively sensitive, i.e., they detonate in small diameters at low temperatures with high detonation velocities without requiring expensive metallic particulate or other energetic sensitizers or dangerous molecular explosive sensitizers. The sensitivity of the compositions is at least partly attributable to the intimate mixture of oxidizer and fuel occasioned by the existence of a fine dispersion of small oxidizer solution droplets that collectively have a high surface area and that are coated by a thin film of liquid hydrocarbon fuel.

2. The sensitivity of the inverted phase compositions is relatively independent of temperature. This is at least partly attributable to the fact that desensitizing crystal growth of any oxidizer salt crystals that may crystallize upon cooling of the composition is limited by the size of the salt solution droplets.Further, the compositions can remain pliable after cooling and crystallization of salt(s), and this is usually not a property of conventional slurries.

3. Although sensitive, the compositions of the present invention are not dangerously sensitive, in the sense that they can remain non-cap-sensitive even though detonable in diameters as small as 1 inch.

4. The compositions allow the effective use of relatively inexpensive liquid hydrocarbon fuels. Although water-immiscible liquid hydrocarbon fuels have been used effectively in conventional compositions under certain circumstances, see, e.g., commonly owned U.S. Pat. Nos. 3,787,254; 3,788,909; and 4,055,449 it has been found difficult to stabilize the fine dispersion of the hydrocarbon liquid fuel throughout the aqueous phase. Bulk-loaded compositions have been known to lose their sensitivity in a few hours due to what appears to be coalescence and breakdown of the fuel dispersion. Storage life is very short. Although the invention disclosed in U.S. Pat. No. 4,055,449 greatly improves storage life of such conventional compositions, the inverted phase compositions of the present invention have even greater storage life, since the risk of fuel coalescence is entirely absent and since little, if any, oxidizer solution coalescence is observed.

5. Additional advantages include resistance to dead pressing, reduced channel effect, resistance to low-temperature desensitivity, and ease of detonability at high densities.

The emulsifier of the present invention is unique and is not disclosed in any of the above-referenced patents. Aliphatic amines have been used as a surfactant for bubble or foam stabilization (U.S. Pat. No. 4,026,738 and United Kingdom Pat. No. 1,456,814), or to impart lipophilic surface characteristics to mixed crystals of co-crystallized AN and potassium salts. Further, U.K. Pat. No. 1,306,546 suggests that laurylamine acetate (12 carbon atoms) may be used as an emulsifier. However, aliphatic amines having a chain length of from 14 to 22 carbon atoms have not been used as emulsifiers for a water-in-oil emulsified slurry composition. The fatty acid amine or ammonium salt emulsifier of the present invention actually performs two functions in addition to that of emulsification. It also acts as a crystal habit modifier in the oxidizer solution to control and limit the growth and size of any salts that may precipitate. This enhances sensitivity since large crystals are known to desensitize slurry compositions. The emulsifier also may enhance absorbtion of the hydrocarbon fuel on the small salt crystals that may form (U.S. Pat. No. 3,684,596). This would tend to increase intimacy of oxidizer and fuel.

SUMMARY OF THE INVENTION

The composition of the invention comprises an inverted phase aqueous blasting composition having a water-immiscible liquid organic fuel as a continuous phase, an emulsified aqueous inorganic oxidizer salt solution as a discontinuous phase, and an emulsifier, which is a fatty acid amine or ammonium salt having a chain length ranging from 14 to 22 carbon atoms.

The method of the invention comprises the step of predissolving the emulsifier in the liquid hydrocarbon fuel during the formulation of the composition prior to adding both ingredients to the inorganic oxidizer salt solution for mixing and emulsification.

DETAILED DESCRIPTION OF THE INVENTION

The oxidizer salt or salts are selected from the group consisting of ammonium and alkali metal nitrates and perchlorates and ammonium and alkaline earth metal nitrates and perchlorates. Preferably, the oxidizer salt is ammonium nitrate (AN) alone or in combination with calcium nitrate (CN) and sodium nitrate (SN). However, potassium nitrate as well as perchlorates can be used. The amount of oxidizer salt employed is generally from about 45% to about 94% by weight of the total composition, and preferably from about 60% to about 86%.

Preferably all of the oxidizer salt is dissolved in the aqueous salt solution during formulation of the composition. However, after formulation and cooling to ambient temperature, some of the oxidizer salt may precipitate from the solution. Because the solution is present in the composition as small, discrete, dispersed droplets, the crystal size of any precipitated salts will be physically inhibited. This is advantageous because it allows for greater oxidizer-fuel intimacy, which is one of the major advantages of an inverted phase slurry. In addition to inhibiting crystal size physically, the emulsifier of the present invention also functions as a crystal habit modifier to control and limit the growth of crystals. Thus, crystal growth is inhibited by both the emulsified nature of the composition and the presence of a crystal habit modified. This dual function of the emulsifier is, as mentioned previously, one of the advantages of the present invention.

Water is employed in an amount of from about 2% to about 30% by weight, based on the total composition. It is preferably employed in amount of from about 5% to about 20%, and more preferably from about 8% to about 16%. Water-miscible organic liquids can partially replace water as a solvent for the salts, and such liquids also function as a fuel for the composition. Moreover, certain organic liquids act as freezing point depressants and reduce the fudge point of the oxidizer salts in solution. This can enhance sensitivity and pliability at low temperatures. Miscible liquid fuels can include alcohols such as methyl alcohol, glycols such as ethylene glycols, amides such as formamide, and analogous nitrogen-containing liquids. As is well known in the art, the amount of total liquid used will vary according to the fudge point of the salt solution and the desired physical properties.

The immiscible liquid organic fuel forming the continuous phase of the composition is present in an amount of from about 1% to about 10%, and preferably in an amount of from about 3% to about 7%. The actual amount used can be varied depending upon the particular immiscible fuel(s) and supplemental fuel(s) (if any) used. When fuel oil is used as the sole fuel, it is preferably used in amount of from about 4% to about 6% by weight. The immiscible organic fuels can be aliphatic, alicyclic, and/or aromatic and can be saturated and/or unsaturated, so long as they are liquid at the formulation temperature. Preferred fuels include benzene, toluene, xylenes, and mixtures of liquid hydrocarbons generally referred to as petroleum distillates such as gasoline, kerosene and diesel fuels. A particularly preferred liquid fuel is No. 2 fuel oil. Tall oil, waxes, paraffin oils, fatty acids and derivatives, and aliphatic and aromatic nitro-compounds also can be used. Mixtures of any of the above fuels can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed above. These additional solid and/or liquid fuels can be added generally in amount ranging up to 15% by weight. If desired, undissolved oxidizer salt can be added to the solution along with any solid or liquid fuels.

The emulsifier of the present invention is a fatty acid amine or ammonium salt. Preferably, the emulsifier has a chain length of from 14 to 22 carbon atoms, and more preferably, from 16 to 18. The emulsifiers preferably are unsaturated and derived from tallow (16 to 18 carbon atoms). As previously mentioned, in addition to functioning as a water-in-oil emulsifier, the emulsifier also functions as a crystal habit modifier for the oxidizer salt in solution. It also may enhance adsorption of the liquid organic fuel on any small salt crystals that may precipitate from solution. The emulsifier is employed in an amount of from about 0.5% to about 5% by weight. It preferably is employed in an amount of from about 1% to about 3%.

The compositions of the present invention are reduced from their natural densities of near 1.5 gm/cc or higher to a lower density within the range of from about 0.9 to about 1.4 gm/cc. As is well known in the art, density reduction greatly enhances sensitivity, particularly if such reduction is accomplished through the dispersion of fine gas bubbles throughout the composition. Such dispersion can be accomplished in several ways. Gas bubbles can be entrained into the composition during mechanical mixing of the various ingredients. A density reducing agent can be added to lower the density by a chemical means. A small amount (0.01% to about 0.2% or more) of a gassing agent such as sodium nitrite, which decomposes chemically in the composition to produce gas bubbles, can be employed to reduce density. Small hollow particles such as glass spheres, styrofoam beads, and plastic microballoons can be employed as the density reducing agent, and this is the preferred density reducing means of the present invention. The use of hollow particles is particularly advantageous where the compositions will be subjected to relatively high pressures, such as 20 psig or more. Because such particles are incompressible prior to detonation, they maintain the compositions's low density, which is necessary for adequate sensitization and thus detonability, under high pressures. Two or more of the above-described common gassing means may be employed simultaneously.

One of the main advantages of an inverted phase slurry over a continuous aqueous phase slurry is, as mentioned previously, that thickening and cross-linking agents are not necessary for stability and water-resistancy. However, such agents can be added if desired.

The aqueous solution of the composition can be rendered viscous by the addition of one or more thickening agents of the type and in the amount commonly employed in the art. Such thickening agents include galactomannin gums (preferably guar gums); quar gum of reduced molecular weight such as described in U.S. Pat. No. 3,890,171; polyacrylamide and analogous synthetic thickeners; flours; and starches. Biopolymer gums, such as those described in U.S. Pat. No. 3,788,909, also can be used. Thickening agents other than flours and starches are generally used in amounts ranging from about 0.05% to about 0.5%, and flours and starches may be employed in much greater amounts, up to about 10%, in which case they also function importantly as fuels. Cross-linking agents for cross-linking the thickening agents also are well known in the art. Such agents are usually added in trace amounts and usually comprise metal ions such as dichromate or antimony ions. The liquid organic, which forms the continuous phase of the composition, also can be thickened, if desired, by use of a thickening agent which functions in an organic liquid. Such thickening agents are well known in the art.

The compositions of the present invention are formulated by preferably first dissolving the oxidizer salt(s) in the water (or aqueous solution of water and miscible liquid fuel) at an elevated temperature of from about 25° C to about 110° C, depending upon the fudge point of the salt solution. The emulsifier and the immiscible liquid organic fuel than are added to the aqueous solution, and the resulting mixture is stirred with sufficient vigor to invert the phase and produce an emulsion of the aqueous solution in a continuous liquid hydrocarbon fuel phase. Usually, this can be accomplished essentially instantaneously with rapid stirring. (The compositions also can be prepared by adding the aqueous solution to the liquid organic.) For a given composition, the amount of agitation necessary to invert the phases can be established by routine experimentation. Stirring should be continued until the formulation is uniform, and then solid ingredients such as microballoons or solid fuel, if any, can be added and stirred throughout the formulation. The examples below provide specific illustrations of degrees of agitation.

It has been found to be particularly advantageous to predissolve the emulsifier in the liquid organic fuel prior to adding the organic fuel to the aqueous solution. Preferably, the fuel and predissolved emulsifier are added to the aqueous solution at about the temperature of the solution. This method allows the emulsion to form quickly and with little agitation. Considerably greater agitation is required if the emulsifier is added to the aqueous solution at or before the time of addition of the liquid organic fuel. This method is another important concept of the present invention.

In illustration of the present invention, the table below contains formulations and detonation results of various compositions of the present invention.

Examples A–L,P and X were prepared according to the procedure described above, except that the emulsifier was not predissolved in the liquid hydrocarbon. In Examples M, N, O, and Q-W, the emulsifier was predissolved in the liquid hydrocarbon. Generally, the compositions were prepared in 10kg batches (approximately 10 liters) in about a 20 liter container and were mixed and agitated by a 2 to 2.5 inch diameter propeller driven by a 2 hp pneumatic motor operating with a pressure source of about 90 to 100 psi. However, some of the compositions were prepared in about a 95 liter open kettle and were mixed by a 3 to 4 inch diameter propeller driven by the same pneumatic motor. The compositions in Examples A–E, G, and H additionally were run through a ½ hp Gifford-Wood colloid mill (7200–9500 rpm). The detonation results for these examples do not indicate any particular advantage resulting from increased agitation in the colloid mill (compare Examples E and F); however, it was found that the stability of the emulsion was enhanced by running the compositions through the mill.

The detonation results were obtained by detonating the compositions in the charge diameters indicated with pentolite boosters weighing from 5 gm to 40 gm or more. The results evidence relatively high sensitivity in small diameters at low temperature without the need for expensive metallic or self-explosive sensitizers. Examples A, E, G, I, and J were tested for cap-sensitivity and were found not to be cap-sensitive, or only marginally so (Example G). Examples A through D contain AN as the sole oxidizer salt and illustrate the effect on sensitivity of adding water. As is evident from these and other of the examples, the sensitivity of the compositions decreased as the water concentration increased. However, the compositions containing higher water contents were more pliable.

Example P, which contained on alkylammonium acetate emulsifier composed of molecules having a chain length as low as 12 (which is below the preferred lower limit chain length of 14), did not detonate.

The compositions of the present invention can be packaged, such as in cylindrical sausage form, or can be directly loaded into a borehole for subsequent detonation. In addition, they can be repumped or extruded from a package or container into a borehole. Depending upon the ratio of aqueous and oil phases, the compositions are extrudable and/or pumpable with conventional equipment. However, the viscosity of the compositions may increase with time depending upon whether the dissolved oxidizer salts precipitate from solution and to what extent. A particular advantage is that the compositions, which can be formulated either on-site (such as in a mobile mixing and pumping truck) for immediate placement or in batch for subsequent placement, can be pumped into a water-containing borehole from the top of the borehole. With conventional slurries, pumping into water-containing boreholes generally is accomlished through a hose that is placed at the bottom of the borehole (with the nozzle below the water-slurry interface) and that is gradually withdrawn as the hole is filled in order to prevent water-slurry intermixture. Because of the inherent water-resistance of the compositions of the present invention, they can be loaded from the top of the borehole without fear of excessive water-slurry intermixture.

The low temperature, small diameter sensitivity and the inherent water-proofness of the compositions render them versatile for use in rendering the compositions economically advantageous for most applications.

While the present invention has been described with reference to certain illustrative examples and preferred embodiments, various modifications will be apparent to those skilled in the art and any such modifications are intended to be within the scope of the invention as set forth in the appended claims.

TABLE

| COMPOSITION INGREDIENTS (Parts by Weight) (Key on next page) | A | B | C | D | E | F | G | H | I | J | K | L | M | N | O | P | Q | R | S | T | U | V | W | X |
|---|---|---|---|---|---|---|---|---|---|---|---|---|---|---|---|---|---|---|---|---|---|---|---|---|
| AN | 75.4 | 74.5 | 72.4 | 67.5 | 62.0 | 62.0 | 44.1 | 33.5 | 41.0 | 48.0 | 60.0 | 51.5 | 40.0 | 30.0 | 35.2 | 63.0 | 38.0 | 38.0 | 38.0 | 38.0 | 40.0 | 37.0 | 38.0 | — |
| CN[i] | — | — | — | — | — | — | 39.2 | 40.0 | 41.0 | — | 30.0 | 20.0 | 40.0 | 50.0 | 37.0 | 20.0 | 40.0 | 40.0 | 40.0 | 40.0 | 40.0 | 38.0 | 40.0 | — |
| SN | — | — | — | — | 13.9 | 13.9 | — | — | — | 14.4 | — | — | — | — | — | — | — | — | — | — | — | — | — | 5.0 |
| SP[m] | — | — | — | — | — | — | — | — | — | — | — | — | — | — | — | — | — | — | — | — | — | — | — | 54.8 |
| KN | — | — | — | — | — | — | — | — | — | 19.2 | — | — | — | — | — | — | — | — | — | — | — | — | — | — |
| $H_2O$ | 15.1 | 17.0 | 20.1 | 25.0 | 13.9 | 13.9 | 4.9 | 15.0 | 8.2 | 2.9 | — | 10.0 | 2.0 | 5.0 | 9.3 | — | 10.0 | 10.0 | 10.0 | 10.0 | 9.0 | 9.0 | 9.0 | 18.2 |
| Emulsifier | 1.5[a] | 1.5[b] | 1.5[a] | 1.5[a] | 1.9[b] | 1.9[b] | 2.0[b] | 2.0[b] | 2.1[a] | 2.9[a] | 2.0[n] | 2.0[n] | 2.0[n] | 1.5[n] | 1.7[n] | 1.0[c] | 3.0[n] | 3.0[n] | 3.0[n] | 3.0[n] | 5.0[n] | 3.0[b] | 2.5[n] | 1.0[n] |
| Liquid Hydrocarbon | 4.0[j] | 3.8[j] | 3.5[j] | 3.0[j] | 4.6[j] | 4.6[j] | 5.9[j] | 5.5[j] | 6.0[j] | 5.3[j] | 3.0[j] | 2.5[j] | 3.0[j] | 2.5[j] | 2.8[j] | 2.0[j] | 2.0[j] | 5.5[s] | 5.5[t] | 5.5[u] | 4.0[j] | 10.0[j] | 4.0[j] | 3.0[j] |
| Density Reducing Agent | 4.0[d] | 3.5[d] | 3.5[d] | 3.0[d] | 3.7[d] | 3.7[d] | 4.0[d] | 4.0[d] | 1.5[e] | 4.0[d] | 1.5[e] | 4.0[d] | 4.0[d] | 0.5[e] | 4.0[d] | 1.0[d] | 0.3[q] | 4.0[d] | 4.0[d] | 4.0[d] | 2.0[e] | 2.0[e] | 2.0[e] | 3.0[d] |
| Liquid Extender | — | — | — | — | — | — | — | — | — | — | 10[f] | — | — | 10.0[o] | — | 13.0[f] | — | — | — | — | — | — | — | 15.0[k] |
| Other Fuel | — | — | — | — | — | — | — | — | — | — | — | — | 10.0[h] | — | 10.0[p] | — | 2.5[r] | — | — | — | — | — | 5.0[v] | — |
| Formulation Temp. ° C | 80–90 | 70–80 | 60–70 | 35–40 | 75 | 80–90 | 70–80 | 25 | 50 | 110 | 110 | 90 | 80 | 40 | 70 | 110 | 70 | 60 | 60 | 60 | 70 | 70 | 70 | 50 |
| Density (g/cc) at 5° C | 1.13 | 1.10 | 1.15 | 1.13 | 1.19 | 1.20 | 1.15 | 1.18 | 1.1 | 1.16 | 1.21 | 1.26 | 1.28 | 1.41 | 1.27 | 1.42 | 1.10 | 1.29 | 1.26 | 1.26 | 1.19 | 1.17 | 1.22 | 1.30 |
| Detonation Results at 5° C[g]: | | | | | | | | | | | | | | | | | | | | | | | | |
| 76mm (3") charge dia. | — | — | — | 5.2 | — | — | — | 4.5 | — | — | — | — | — | — | — | — | — | — | — | — | — | — | — | — |
| 63.5mm (2½") | 5.4 | — | 5.1 | F | 5.7 | 5.1 | — | — | — | — | — | — | — | — | — | F | — | — | D | 4.6 | D | 4.9 | D | — |
| 51mm (2") | 5.3 | 5.2 | 5.0 | | 5.3 | 4.9 | 4.6 | 4.4 | — | — | — | — | 5.0 | 4.9 | — | — | — | 4.2 | 4.6 | 4.6 | 5.0 | 4.7 | 4.7 | — |
| 38mm (1½") | 4.9 | 4.5 | F | — | 5.5 | F | 4.6 | F | 4.7 | 4.5 | 5.1 | 4.4 | 4.6 | F | 3.8 | — | 5.0 | F | F | F | 4.5 | D | 4.5 | D |
| 25.4mm (1") | 4.4 | F | — | — | 4.4 | — | 4.9 | — | — | D | — | F | 4.3 | — | F | — | — | — | — | — | F | F | 4.2 | F |
| 19mm (¾") | F | — | — | — | F | — | D | — | D | F | — | — | F | — | — | — | — | — | — | — | — | — | F | — |

Key:
[a]Alkylammonium acetate equivalent to "b" below
[b]Alkylammonium acetate composed of saturated molecules having a chain length of from 16 to 18 carbon atoms (Armak "Armac HT")
[c]Alkylammonium acetate, 12 to 18 carbon atoms, "Armac C"
[d]Glass microballoons (3-M "E22X")
[e]Plastic microballoons (Dow "Saran")
[f]Formamide
[g]The decimal number is detonation velocity in km/sec; F = failure, D = detonation
[h]Sugar
[i]Fertilizer grade comprising 81:14:5 CN:$H_2O$:AN
[j]No. 2 fuel oil
[k]Ethylene glycol
[l]Methanol
[m]Sodium perchlorate
[n]Alkylammonium acetate, unsaturated molecules having a chain length of from 16 to 18 carbon atoms ("Armac T")
[o]Methanol
[p]Aluminum particles
[q]Chemical foaming agent
[r]Paraffin
[s]Benzene
[t]Toluene
[u]Xylene
[v]Sulfur

What is claimed is:

1. In an inverted phase aqueous blasting composition having a water-immiscible liquid organic fuel as a continuous phase, an emulsified aqueous inorganic oxidizer salt solution as a discontinuous phase, and an emulsifier; the improvement comprising, as the emulsifier, from about 0.5% to about 5.0% by weight, based on the total composition, of a fatty acid amine or ammonium salt having a chain length ranging from 14 to 22 carbon atoms.

2. A composition according to claim 1 wherein the emulsifier has a chain length ranging from 16 to 18 carbon atoms.

3. A composition according to claim 2 wherein the emulsifier is an alkylammonium acetate.

4. A composition according to claim 1 wherein the liquid organic fuel is selected from the group consisting of benzene, toluene, xylene, and petroleum distillates such as gasoline, kerosene, and diesel fuels.

5. A composition according to claim 4 wherein the fuel is No. 2 fuel oil.

6. A composition according to claim 1 wherein the oxidizer salt is selected from the group consisting of ammonium, calcium, and sodium nitrate and combinations thereof.

7. A composition according to claim 1 containing a density reducing agent in amount sufficient to reduce the density of the composition to within the range of from about 0.9 to about 1.4 gm/cc.

8. A composition according to claim 7 wherein the density reducing agent is selected from the group consisting of small, dispersed glass or plastic spheres or microballoons; a chemical foaming or gassing agent; and a combination of each.

9. A composition according to claim 1 wherein the aqueous solution contains a water-miscible organic liquid fuel.

10. A composition according to claim 9 wherein the water-miscible organic liquid fuel is selected from the group consisting of methanol, ethylene glycol, formamide, and mixtures thereof in an amount of from about 1% to about 15% by weight, based on the total composition.

11. An inverted phase aqueous blasting composition comprising a water immiscible liquid organic fuel as a continuous phase in an amount of from about 1% to about 10% by weight based on the total composition; and emulsified aqueous inorganic oxidizer salt solution comprising water in an amount of from about 5% to about 20% and inorganic oxidizer salt in an amount of from about 60% to about 94%; and, as an emulsifier, a fatty acid amine or ammonium salt having a chain length ranging from 14 to 22 carbon atoms and in an amount of from about 0.5% to about 5.0%.

12. A composition according to claim 11 comprising from about 3% to about 5% fuel oil, from about 8% to about 12% water, and an alkylammonium acetate emulsifier.

13. A composition according to claim 12 containing small, dispersed glass or plastic spheres or microballoons in sufficient amount to reduce the density of the composition to within the range of from about 0.9 to about 1.4 gm/cc.

14. A composition according to claim 11 wherein the oxidizer salt solution contains from about 1% to about 10% of a water-miscible organic liquid fuel selected from the group consisting of methanol, ethylene glycol, formamide, and mixtures thereof.

15. A method of formulating an inverted phase aqueous blasting composition comprising a water-immiscible liquid organic fuel as a continuous phase, an emulsified aqueous inorganic oxidizer salt solution as a discontinuous phase, and from about 0.5% to about 5.0% by weight, based on the total composition, of a fatty acid amine or ammonium salt emulsifier having a chain length ranging from 14 to 22 carbon atoms; which method includes the steps of predissolving the emulsifier in the liquid organic fuel prior to adding these components to the salt solution, and mixing or stirring the components to form the inverted phase emulsion.

* * * * *